US009234643B2

(12) United States Patent
Lagutko

(10) Patent No.: US 9,234,643 B2
(45) Date of Patent: Jan. 12, 2016

(54) LED LIGHTING LAMP

(75) Inventor: Kszysztof Wlodzimierz Lagutko, Warsaw (PL)

(73) Assignee: LARS CO. SPOLKA Z OGRANICZONA ODPOWIEDZIALNOSCIA, Piaseczno (PL)

( * ) Notice: Subject to any disclaimer, the term of this patent is extended or adjusted under 35 U.S.C. 154(b) by 466 days.

(21) Appl. No.: 13/581,092

(22) PCT Filed: Feb. 24, 2011

(86) PCT No.: PCT/PL2011/000022

§ 371 (c)(1), (2), (4) Date: Dec. 6, 2012

(87) PCT Pub. No.: WO2011/105920

PCT Pub. Date: Sep. 1, 2011

(65) Prior Publication Data

US 2013/0077306 A1 Mar. 28, 2013

(30) Foreign Application Priority Data

Feb. 25, 2010 (PL) ..... 390552

(51) Int. Cl.
*F21V 5/00* (2015.01)
*F21V 5/04* (2006.01)
(Continued)

(52) U.S. Cl.
CPC ... *F21V 5/04* (2013.01); *F21S 8/03* (2013.01); *F21V 23/0471* (2013.01); *F21W 2111/027* (2013.01); *F21W 2131/10* (2013.01); *F21Y 2101/02* (2013.01)

(58) Field of Classification Search
CPC ..... F21W 2111/027; F21W 2131/30; F21V 5/04; F21V 23/0471; F21V 15/01; F21V 21/08; F21V 21/30; F21V 29/006; F21V 29/89; F21V 27/00; F21Y 2111/007; F21Y 2111/004; F21Y 2105/003; F21S 2/005; F21S 8/03; F21S 8/036
USPC ..... 362/244, 488, 490, 133, 146, 147, 151, 362/153, 641, 642, 644, 645, 237, 374, 802, 362/373, 294, 264, 218, 547
See application file for complete search history.

(56) References Cited

U.S. PATENT DOCUMENTS 6,932,489 B2 * 8/2005 Sooferian ..... 362/145
7,327,254 B2 * 2/2008 Chen ..... 340/545.2
(Continued)

FOREIGN PATENT DOCUMENTS

| | | |
|---|---|---|
| DE | 202009010306 | 11/2009 |
| GB | 2445103 | 6/2008 |
| JP | 2001325810 | 11/2001 |

*Primary Examiner* — Jason Moon Han
*Assistant Examiner* — Omar Rojas Cadima
(74) *Attorney, Agent, or Firm* — Horst M. Kasper

(57) ABSTRACT

An LED lighting lamp contains a cover, having a port for power leads, ports for cover fixing, an external collar, catches, feeding socket and feeders' connecting cube, fixed inside the cover to its bottom; a housing, having an external collar with rectangular recess, protrusions arranged on the vertical walls inside the housing, bars, catches, a seat in which the PIN ends are fastened to be connected with feeding socket, wherein the catches are connected with cover catches; an electronic board of the feeder, with ports for housing bars, electronic elements and electrical connectors placed on the upper surface as well as connector support placed on the lower surface; insulation molder, fastened in the housing collar's recess and having a central rectangular cavity with rectangular and round ports in its bottom; a radiator in the form of a rectangular molder, fastened in the cavity of insulation molder and having on its upper surface a central rectangular seat, inside which, at least two bars and one port are placed on its lower surface.

15 Claims, 2 Drawing Sheets

(51) Int. Cl.

| | |
|---|---|
| ***F21S 8/00*** | (2006.01) |
| ***F21V 23/04*** | (2006.01) |
| *F21W 111/027* | (2006.01) |
| *F21W 131/10* | (2006.01) |
| *F21Y 101/02* | (2006.01) |

(56) References Cited

U.S. PATENT DOCUMENTS

| | | | | |
|---|---|---|---|---|
| 8,083,392 | B2 * | 12/2011 | Chien | 362/641 |
| 2003/0090896 | A1 | 5/2003 | Sooferian | |

* cited by examiner

CROSS-SECTION A-A

CROSS-SECTION B-B

LED LIGHTING LAMP

FIELD OF THE INVENTION

The present invention relates to the LED lighting lamp being a light source suitable for illuminating rooms, staircases, corridors, passageways, cellars—all the places, where temporary space lighting is needed.

BACKGROUND OF THE INVENTION

The solutions of staircases', passageways' and cellars' lighting based on traditional incandescent bulbs, fluorescent lamps or energy-saving bulbs, switched on by conventional circuit-breakers and equipped with time-lag switches, turning the lights off after a pre-set time, regardless of whether the user or users need such lighting or not—are commonly known. Another drawback of such solutions is the need to install multiple switches and connect them by electric wiring with power line supplying light sources.

The solutions of staircases', corridors', passageways' and cellars' lighting based on traditional lamp with an external motion sensor and time-lag switch, turning the lights off after a pre-set time, regardless of whether the user or users need such lighting or not are also commonly known. The advantages of these solutions consist in eliminating the need of searching for circuit-breaker in a dark room as well as lower power consumption compared to no motion sensor lighting (for example—nine times lower). The inconvenience of these solutions is, that due to the high working temperature of traditional light-bulbs requires the motion sensor to be installed not closer than 0.5 meters from them, which causes high costs of equipment, due to high installation costs. Another important drawback consists in frequent need to exchange light-bulbs, especially energy-saving ones, due to their short life in continuous switching on and off cycles. Another inconvenience leading to installation costs increase is the need to mount motion sensors at all entrances or on each floor.

In turn, possibilities to apply LED lamps were so far limited, due to their too weak power. When high power LEDs appeared, carrying away of heat—especially in case of diodes working in lighting sets—has become a problem.

The object of present invention is to provide the LED lamp construction suitable for illuminating rooms, staircases, corridors, passageways and cellars, which could enable an efficient carrying away of heat emitted by operating LEDs, especially HB LED type, and consequently, give possibility to assemble in one housing lighting elements of any power and, at least, a motion sensor and/or other sensors.

Furthermore, the present invention is aimed at achieving lighting LED lamp construction, allowing its easy and simple installation and servicing, without using specialized equipment.

The present invention is also aimed at working out a lighting LED lamp structure, allowing to exploit the existing lighting installations—supplying points, without doing additional mounting works.

SUMMARY OF THE INVENTION

The object of invention have been achieved by designing a LED lamp, which—according to its concept—contains: a cover in the form of cubicoid open at the top, with "U" letter shaped cross-section, having a port for power leads, ports for cover fixing, an external collar, catches, feeding socket and feeders' connecting cube, fixed inside the cover to its bottom; a housing in the form of cubicoid open at the top, with "U" letter shaped cross-section, having an external collar with rectangular recess, protrusions arranged on the vertical walls inside the housing, bars, catches, a seat in which the PIN ends are fastened to be connected with feeding socket, wherein the catches are connected with cover catches; an electronic board of the feeder, with ports for housing bars, electronic elements and electrical connectors placed on the upper surface as well as connector support placed on the lower surface and connected with PIN end's pins of the housing's seat; insulation moulder in the form of a rectangular plate, fastened in the housing collar's recess and having a central rectangular cavity with "U" letter shaped cross-section and rectangular and round ports in its bottom; a radiator in the form of a rectangular moulder, fastened in the cavity of insulation moulder and having on its upper surface a central rectangular seat with "U" letter shape cross-section, inside which, at least two bars and one port are placed on its lower surface; two rectangular seats with "U" letter shaped cross-section, placed in parallel on both sides of the central seat, having a depth lower than the central seat as well as the equal width, each of them having in its bottom a port and at least two bars situated on the lower surface of the radiator, which pass through the holes in insulation moulder, pressing the electronic board of the feeder against protrusions in housing, and—at least—two ports for screws, insulation moulder fixed in the central seat of radiator and having in its bottom at least two ports for bars, one rectangular port with a collar situated on the external surface of insulation moulder's bottom, passing outside radiator through the rectangular hole in the bottom of radiator's central cavity; PIR sensor electronic board, fastened in the insulation moulder, keeping a gap from its bottom and supported by the radiator's bars; at least two plates with LEDs, fastened in radiator's shallow seats in such a way that the lower surface of the plate keeps direct contact with the bottom surface of radiator's seat; a rectangular frontal plate, connected by screws to the bars and fixing the radiator in insulation moulder's cavity, having a central rectangular hole, notches in the corners, ports for screws and an insulating moulder in housing collar's recess, top cover in the form of rectangular moulder, having at least two longitudinal, rectangular ports with seats from underneath, a central large-diameter port, two small-diameter ports situated on opposite sides of the central port and having seats from the top cover's bottom side, at least two protrusions with springy catches, situated along opposite sides of the top cover, fastened in the frontal plate's notches and connecting the top cover with the frontal plate; light source lenses, fixed with LED plates in radiator's seats by use of seats in the top cover, pressing LED plates against seats' bottoms; optical element of PIR sensor, fitted in the central port, between PIR sensor electronic board and the top cover, and adjustment knobs, fixed in top cover's seats, between PIR sensor electronic board and the top cover.

Preferably, the cover has a collar in the form of cylinder, in which a feeding socket as well as a seat to fix the connecting cube are fastened.

Preferably, the feeding socket is fixed to the cover's bottom with screws and nuts.

Preferably, the housing has on its lower surface a collar in the form of cylinder, concentric with the seat for an additional feeding socket's insulation.

Preferably, the bars have ends with smaller diameters than their other sections, allowing them to enter into the holes in the electronic board of the feeder.

Preferably, the bars have ends with smaller diameters than their other sections, allowing them to enter into the holes in PIR sensor electronic board.

Preferably, on the upper surface of the PIR sensor electronic board a base and electronic elements of PIR sensor are fixed, while electrical outputs in the form of pins, passing through insulation moulder's collar and introduced to the connector in the electronic board of the feeder are placed on the lower surface of the PIR sensor electronic board.

Preferably, the electronic LEDs plate has electronic elements and at least one LED fixed on its upper surface, while electrical outputs in the form of pins, passing through the hole in radiator's seat and introduced to the connector in the electronic board of the feeder are placed on the lower surface.

Preferably, a cuboidal moulder of trapezoidal cross-section, having an internal longitudinal channel with a convex, half-round bottom makes the light source lens.

Preferably, the light source lens is constituted by an eliptical lens compound.

Preferably, a dome is the optical element of PIR sensor.

Preferably, a Fresnel lens is the optical element of PIR sensor.

Preferably, springy catches make the integral part of top cover's protrusions.

Thanks to the applied lamp construction according to the invention it was possible to integrate the lamp with a motion sensor in one compact housing, which allowed to eliminate logistic problem as well as the mounting costs—the mounting is the same as in case of usual ceiling fittings and it is possible to use the existing outputs of lighting installation.

The application of low thermal resistance materials for installation of LEDs extends the life of lamps.

The application of double voltage insulation ensures compliance with safety standards and CE requirements.

The application of special designs enables fully automatic installation, eliminating manual works.

BRIEF DESCRIPTION OF THE DRAWINGS

The subject of invention is shown in the drawing, where.

DETAILED DESCRIPTION OF THE INVENTION

Figure 1:
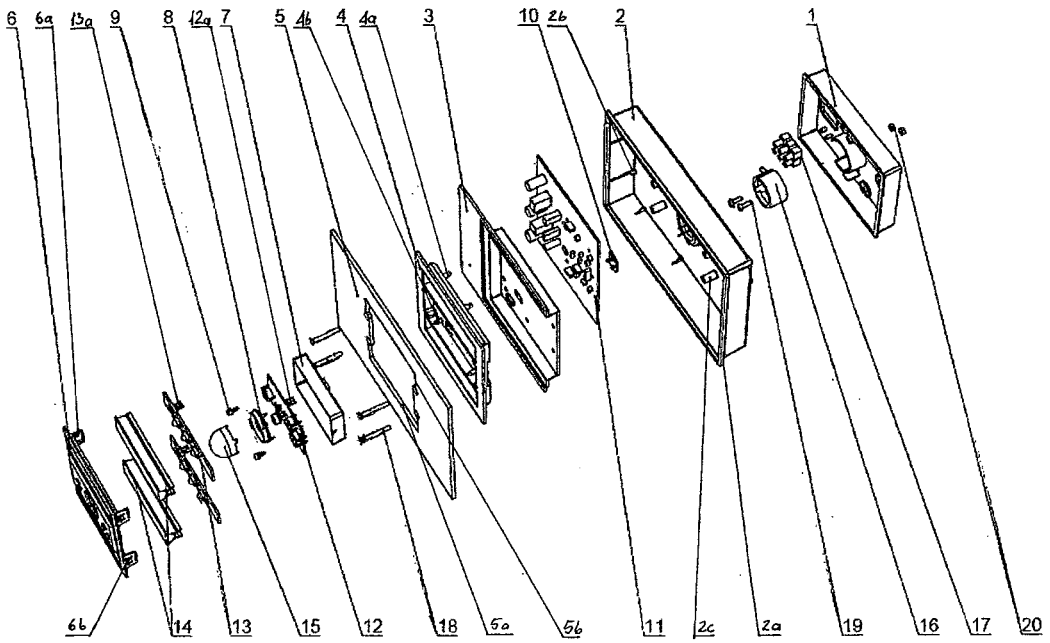
FIG. 1 shows an advisable execution of LED lighting lamp, made according to the invention is presented in exploding, perspective side-view.
Figure 2:
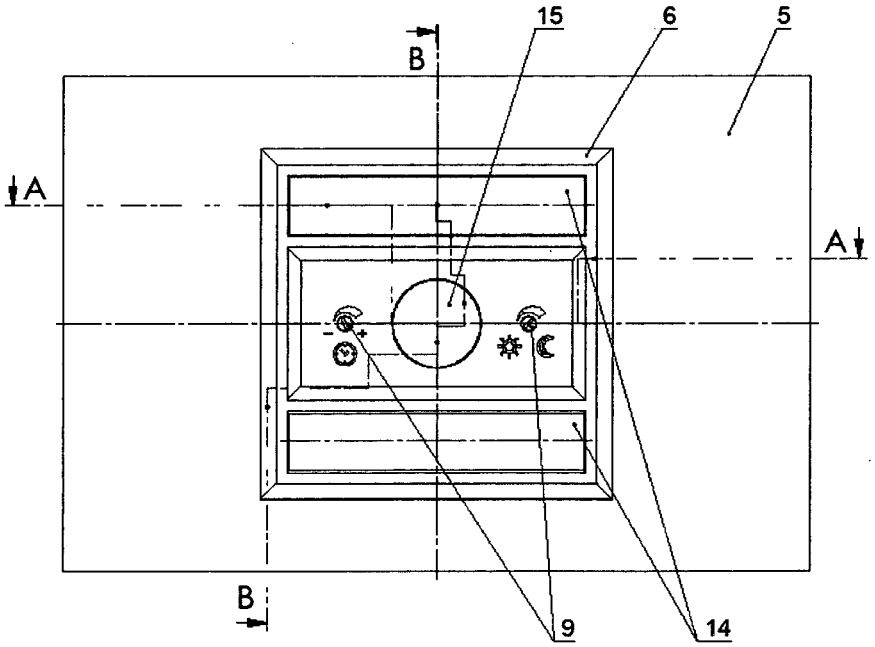
FIG. 2 shows the LED lighting lamp in front-view.
Figure 3:
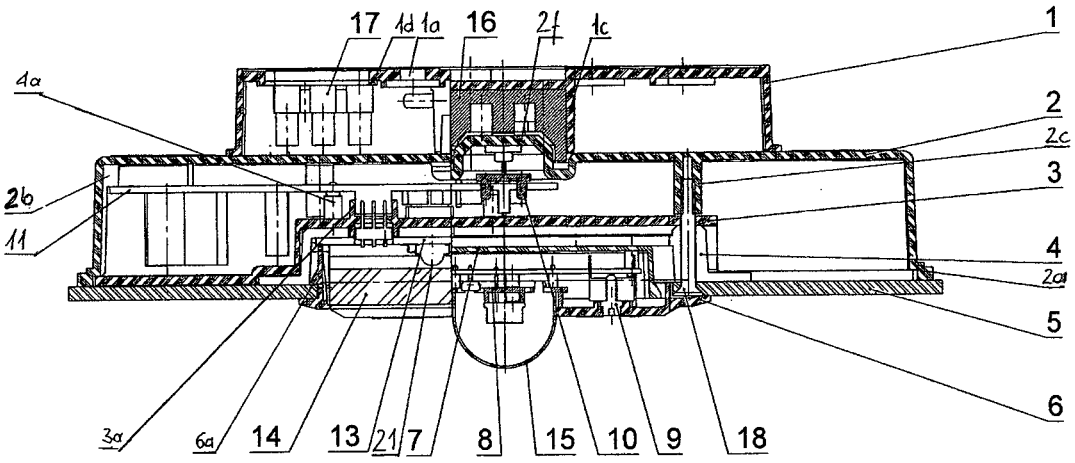
FIG. 3 shows the LED lighting lamp in A-A (as marked in FIG. 2) cross-section.
Figure 4:
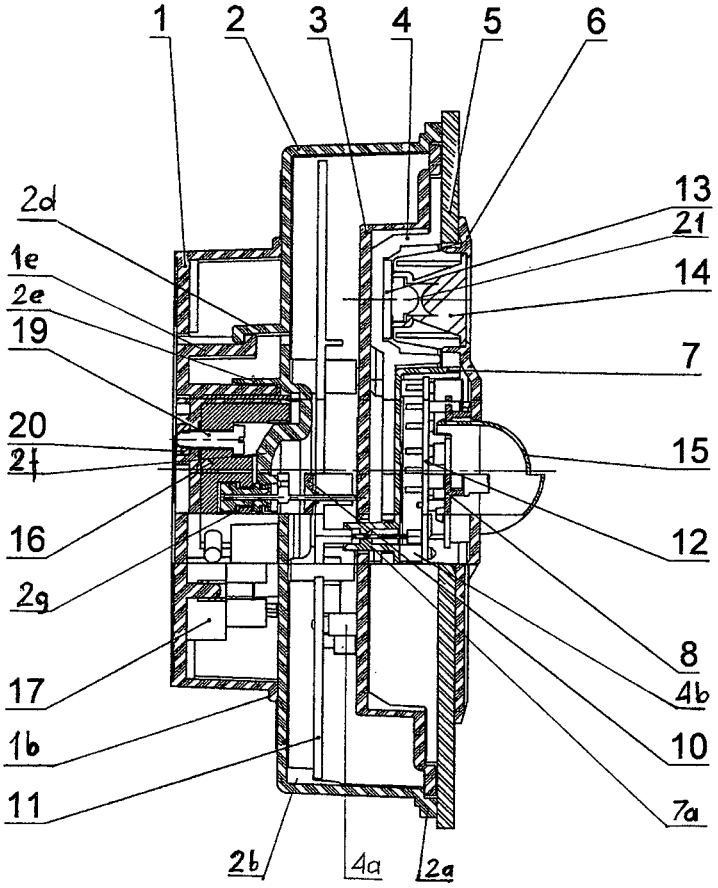
FIG. 4 shows the LED lighting lamp in B-B (as marked in FIG. 2) cross-section is shown in FIG. 4.

The LED lighting lamp made according to the invention has been described as in advisable execution example presented in FIG. 1, FIG. 2 and FIG. 3. The LED lighting lamp made according to the invention is composed of feeding socket's 17 cover 1, feeder's housing 2, electronic board of feeder 11, feeder's insulation moulder 3, radiator 4, insulation moulder 7, plates 13 with LEDs 21, PIR sensor electronic board 12, protective dome 15 of PIR sensor, lenses 14, frontal plate 5 and top cover 6. The frontal plate is connected with housing 2 by use of screws 18.

The cover 1 of feeding socket has a form of a cubicoid open at the top, with "U" letter shaped cross-section, having a port 1*a* for power leads, the external collar 1*b* on the circumference of the upper, open part as well as the seat 1*c* to fit the feeding socket 16, and the seat 1*d* to fix the feeders' connecting cube 17, which are placed on the internal, bottom surface of the cover.

The cover 1 is equipped with catches 1*e* to be connected with catches 2*d* of the housing 2. The catches 1*e* and 2*d* have, for example, the form of hooks. The feeding socket 16, for example, a socket of GU 10 type, is fastened firmly in the seat 1*c* of the housing 1—for example with screws 19 and nuts 20. The feeders' connecting cube 17 is fastened to the bottom of the cover 1. The holes in the cover 1 serve to fasten it on the wall, ceiling or other surface. The cover 1 is fastened at the points, in which lighting point is foreseen.

It is obvious, that the cover 1 does not need to be equipped with the seat 1*c* for fitting the feeding socket 16 as well as the seat 1*d* for feeders' connecting cube 17 fixing—both the feeding socket 16 and feeders' connecting cube 17 can be mounted directly on the surface of cover's 1 bottom.

It is also obvious, that any optional way to fasten the socket 16 and connecting cube 17, for example by riveting, gluing etc., is admissible.

The cover 1 is made of any electroinsulating plastic, preferably of ABS (Acrylonitrile Butadiene Styrene).

The feeder's housing 2 has a form of a cubicoid open at the top, with "U" letter shape cross-section, having the external collar 2*a* with rectangular recess around the whole circumference of the upper open part, the protrusions 2*b* for fixing the feeder's electronic board 11 inside the housing, arranged on vertical walls of the housing 2 as well as the bars 2*c* for fastening the frontal plate 5, by—for example—screws 18. The housing 2 has catches 2*d* at its bottom, the collar 2*e* in the form of a cylinder and the seat 2*f*. The collar 2*e* is designed for an additional feeding socket's 16 insulation and it facilitate the insertion of the seat 2*f* and 2*g* ends into the hole in the socket 16 during assembly of the lamp. In the seat 2*f* two standard PIN ends 2*g* are mounted. They have pins designed to connect through the base of terminal 10 with feeder's electronic board 11 and to provide feeding voltage from feeding socket 16.

The housing 2 is made of any electroinsulating plastic, for example—of ABS.

The feeder's electronic board 11 is made of standard laminate, to which electronic elements and joints are fastened, to make connections—for example, by use of pins—with the socket 16, the PIR sensor electronic board 12 and the plates with LEDs 21. The base of network feeder's terminal 10 is fastened on the lower surface of the electronic board 11. The electronic board 11 has ports designed for bars 2*c* for screws 18 fixing the frontal plate 5.

The insulation moulder 3 has the form of a rectangular plate with central rectangular cavity with "U" letter shaped cross-section. In this cavity the radiator 4 is fixed. The insulation moulder 3 has rectangular ports for pins 12*a* of PIR sensor electronic board 12 and for pins 13*a* of plates 13 with LEDs 21 as well as round ports for bars 4*a* of the radiator 4. In order to ensure an additional insulation of pins 12*a*, 13*a* against their contact with radiator 4, i.e. in order to prevent a short-circuit, guide collars along edges of rectangular holes on both surfaces of the insulation moulder 3 may be made. The insulation moulder 3 is fixed in recess of the collar 2*b* of the housing 2 and immobilized by the frontal plate 5.

The insulation moulder 3 is made of any electroinsulating plastic, for example—of ABS.

The radiator 4 has the form of a rectangular, monolithic moulder with central, rectangular seat. Inside the seat, on its lower surface four bars 4*b* and two rectangular seats having equal width are placed in parallel on both sides of the central seat. Their depth is smaller than the depth of the central seat.

Inside the central seat of radiator 4 the insulation moulder 7, containing PIR sensor electronic board 12 and in radiator's 4 side seats the plates 13 with LEDs 21 are fixed.

On the lower surface of radiator 4 four bars 4*a* are placed. They pass through holes in the insulation moulder 3 of the feeder and press the electronic board of the feeder 11 against the protrusions 2*b* and housing 2.

The ends of bars 4*a* may preferably have a smaller diameter than remaining sections of bar 4*a*, so that—when the bars 4*a* have passed through the holes in the insulation moulder 3—they could enter into respective holes in the electronic board of the feeder 11 and press the electronic board of the feeder 11 against protrusions 2*b* of the feeder's housing 2, preventing displacement of feeder's electronic board 11 inside the housing 2.

After having passed through the respective holes in insulation moulder 7, bars 4*b* raise PIR sensor electronic board 12 above the surface of insulation moulder's 7 bottom in order to reach a gap between the surface of PIR sensor electronic board 12 and the surface of insulation moulder's 7 bottom.

The ends of bars 4*b* may preferably have a smaller diameter than remaining sections of bar 4*b*, so that they could enter into the respective holes in the PIR sensor electronic board 12 and prevent displacement of PIR sensor electronic board 12 inside insulation moulder 7.

The bars 4*a* and 4*b* may be preferably made as integral parts of radiator 4—for example, during the casting of radiator 4. They may be also manufactured as separate parts—for example as threaded ends bars, screwed or thrust into radiator 4 etc.

The radiator 4 has four ports for screws 18, made advisably along shorter sides of the central seat.

The radiator 4 is made of low thermal resistance material, for example—of aluminium or aluminium alloys.

The insulation moulder 7 has four round holes for passing bars 4*b* through them and one rectangular hole for pins 12*a* of PIR sensor electronic board 12. On its lower surface there is also an advisable cuboidal collar 7*a*, placed around this hole and isolating pins 12*a* from radiator 4.

The insulating moulder 7 is made of insulating material, preferably of plastic, for example—of ABS.

The PIR sensor electronic board 12 is made of standard laminate. On the upper surface of the board electronic elements and PIR sensor base 8 made of insulating material are fastened. The electronic plate 12 has electrical terminals, for example—in the form of pins 12*a*. The pins 12*a* pass through the hole in insulation moulder 7, advisable through the collar 7*a* of the insulation moulder 7, placed in the hole of radiator 4, and are introduced into the respective joint on feeder's electronic board 11.

The electronic plate 13 with LEDs 21 is a plate made of standard laminate, preferably of Alu PCB or MSPCB. On its upper surface electronic elements and at least one LED 21 are fixed, and the plate has electrical terminals, for example—in the form of pins 13*a*. The pins 13*a* pass through the holes in radiator's 4 seats and are introduced into the respective joints on feeder's electronic board 11. The lower surface of electronic plate 13 keeps direct contact with the surface of radiator's 4 seat, in order to improve the transfer of heat from LEDs 21 to radiator 4.

The frontal plate 5 of the lamp has the form of rectangular plate with central, rectangular hole 5*a* with notches 5*b* in the corners, made in such way, that two opposite rectangular protrusions with ports for screws 18 are placed on the hole axis. The screws 18 are screwed into the housing 2 bars 2*c*, combining into a single unit the frontal plate 5, radiator 4 feeder's insulation moulder 3, feeder's electronic board 11 and housing 2.

The frontal plate 5 is made of low thermal resistance material, for example—of aluminium or aluminium alloys.

The direct contact of radiator 4 with frontal plate 5 increases significantly the transfer of heat from LEDs 21 to the environment, which allowed to install PIR sensor in the immediate vicinity of LEDs 21.

The top cover 6 has the form of a rectangular moulder with two longitudinal, rectangular ports. These ports have at their bottoms seats for fixing lenses 14, for example—an eliptical lens compound of light sources or in form of rectangular moulder of trapezoidal cross-section, having an internal longitudinal channel with a convex, half-round bottom. The top cover 6 of the housing has also a central port designed for fixing PR sensor's protective dome 15 or Fresnel lens, as well as two ports situated on the opposite sides of this hole. These ports have seats placed from the bottom side of top cover 6, for adjustment knobs 9 fixing. Along shorter sides of the top cover 6 there are four 6*a* protrusions, making advisably integral part of the top cover 6 and equipped with catches 6*b* for fastening the top cover 6 in the opening of frontal plate 5. Springy catches 6*b* may have any structure, but it is advisable to make them as integral part of 6*a* protrusions of the top cover 6. The protrusions 6*a* mate with notches 5*b* situated on the circumference of rectangular hole 5*a* in the frontal plate 5.

It is obvious that the top cover 6 may not be equipped with 6*a* protrusions with springy catches 6*b* and can be fastened to the frontal plate 5 with screws or any other way.

The top cover 6 is made of any electroinsulating plastic, for example—of ABS. The assembling of the lamp consists in mounting the cover 1 set i.e. in connecting the socket 16 and connecting cube 17 with the cover 1. The socket 16 and cube 17 are connected by electric cables.

Simultaneously, the assembling of lighting set can be done. It consists in placing feeder's electronic board 11 in the housing 2: feeder's electronic board 11 supports on housing 2 walls' protrusions 2*b*, then insulation moulder 3 is placed in the recess in collar 2*a* and, after that, the radiator 4 is placed in it, by introducing radiator 4 bars 4*a* into the respective holes in feeder's insulation moulder 3. Using its bars 4*a* radiator 4 presses feeder's electronic board 11 against protrusions 2*b*. In case of applying bars 4*a* with smaller diameter ends, these ends are introduced into the respective holes in feeder's electronic board 11, which prevents displacing feeder's electronic board 11 inside the housing 2.

After fixing the radiator 4, the frontal plate 5 is being set and all details and units are combined into a single assembly, by use of screws 18 screwed into the bars 2*c* of the housing 2. After connecting frontal plate 5 with housing 2, plates 13 with LEDs 21 and insulation moulder 7 are placed in radiator's 4 seats. Then, PIR sensor electronic board 12 together with fixed protective dome 15 and adjustment knobs 9 are placed in bars 4*b*. Thanks to the bars 4*b* of radiator 4, the board 12 is fixed in the insulation moulder 7 keeping a distance from the bottom. In case of applying bars 4*b* with smaller diameter ends, these ends are introduced into the respective holes in PIR sensor electronic board 12, which prevents displacing PIR sensor electronic board 12 inside the insulation moulder 7.

Then, the lenses 14 are fitted in radiator's 4 seats, in which plates 13 with LEDs 21 have been previously placed, and the whole unit is closed with the top cover 6, by pressing catches 6*b* of the top cover 6 in notches 5*b* of the frontal plate 5. The cover 6 presses lenses 14 against plates 13 with LEDs 21 to the bottom of the seat, the plates—in turn—are pressed to the bottom of seats in radiator 4, ensuring better carrying away of heat. It also fasten the adjustment knobs 9, placed in seats in the top cover 6, preventing their falling out or displacement.

Such constructional solution of the lamp, according to the invention, giving—after the final assembling—two autonomous units i.e. feeding socket cover unit 1 and lighting unit, composed of the housing 2 containing feeder and LEDs 21 mounted inside it, allows an emergency, temporary replacement of the lighting unit with a light bulb having an adequate cap—for example, if the feeding socket 16 mounted in the cover 1 represents the GU 10 type, the light bulb with GU 10 cup is applied. The construction of the lamp according to the invention facilitate its assembling in situ (in place of use)—the access to the inside of the cover 1 as well as its assembling on the required surface is easy. It is also easy and safe to connect the lamp to a power source—the feeding cables have to be connected to the connecting cube 17 only, other lamp units are disconnected and there is no danger of their accidental launch.

The isolation of feeding socket 16 from other parts, by placing it in separate housing—cover 1, full isolation of feeder's electronic board 11 from environment and feeding socket 16 through its hermetic closure in housing 2 by use of insulation moulder 3, isolation of PIR sensor electronic board 12—confined in insulation moulder 7 closed by the top cover 6, as well as the application of electrically insulated passages for connectors—such as collars in insulation moulders 3 and 7 allowed to achieve a very high voltage insulation, which was never reached in other alternative solutions found in the market.

The lighting unit is connected with the cover 1 by inserting ends 2*g* of the seat 2*f* in the holes of the feeding socket 16. The collar 2*e* is designed to give the feeding socket 16 an additional insulation. It also facilitate the insertion of seat 2*f* into the feeding socket 16, and then it makes easier turning the whole unit in relation to the cover 1 in order to achieve mechanical connection of its catches 1*e* with catches 2*d* of the housing 2. In order to disassembly the unit, the housing 2 should be rotated again in relation to the cover 1. The cover 1 should be connected with the lighting unit before transportation or after fixing the cover 1 in lamp working place.

It is obvious, that constructional solutions presented above are taken by the way of example and do not impose restrictions on the essence of the invention.

The invention claimed is:

1. An LED lighting lamp characterized in that it contains the cover (1) in the form of cuboid open at the top, with "U" letter shaped cross-section, having a port (1*a*) for power leads, ports for cover (1) fixing, an external collar (1*b*), catches (1*e*) feeding socket (16) and feeders connecting cube (17), fixed inside the cover (1) to its bottom; a housing (2) in the form of cuboid open at the top, with "U" letter shaped cross-section, having an external collar (2*a*) with rectangular recess, protrusions (2*b*) arranged on the vertical walls inside the housing (2), bars (2*c*), catches (2*d*), a seat (2*f*) in which pin ends (2*g*) are fastened to be connected with feeding socket (16), wherein the catches (2*d*) are connected with cover (1) catches (1*e*); an electronic board of the feeder (11), with ports for housing (2) bars (2*c*), electronic elements and electrical connectors placed on its upper surface as well as connector support (10) placed on its lower surface and connected with the pin ends (2*g*) of the housings (2) seat (2*f*); first insulator form of a rectangular plate, fastened in the housing (2) collar's (2*a*) recess and having a central rectangular cavity with "U" letter shaped cross-section and rectangular and round ports in its bottom; a radiator (4) in the form of a rectangular mold molder, fastened in the cavity of first insulator (3) and having on its upper surface a central rectangular seat with "U" letter shape cross-section, inside which, at least two bars (4*b*) and one port are placed on its lower surface; two rectangular seats with "U" letter shaped cross-section, placed in parallel on both sides of the central rectangular seat, having a depth lower than the central rectangular seat and having equal widths with each other, each of them having in its bottom a port and at least two bars (4*a*) situated on the lower surface of the radiator (4), which pass through the holes in first insulator (3), pressing the electronic board of the feeder (11) against protrusions (2*b*) in housing (2), and—at least—two ports for screws (18), second insulator (7) fixed in the central rectangular seat of radiator (4) and having in its bottom at least two ports for bars (4*b*), one rectangular port with a collar (7*a*) situated on the external surface of second insulator (7) bottom, passing outside radiator (4) through the one port in the bottom of radiator's (4) central rectangular seat; PIR sensor electronic board (12), fastened in the second insulator (7), keeping a gap from its bottom and supported by the radiator's bars (4*b*): at least two plates (13) with LEDs (21), fastened in radiator's (4) two rectangular seats in such a way that the lower surface of the plate (13) keeps direct contact with the bottom surface of radiator's (4) two rectangular seats seat; a rectangular frontal plate (5), connected by screws (18) to the bars (2*c*) and fixing the radiator (4) in first insulator's (3) cavity, having a central rectangular hole (5*a*), notches (5*b*) in the corners, ports for screws (18) and an insulating first insulator (3) in housing (2) collar's (2*a*) recess, top cover (6) in the form of rectangular mold, having at least two longitudinal, ports with seats underneath, a central large-diameter port, two small-diameter ports situated on opposite sides of the central large-diameter port and having seats on the top cover's (6) bottom side, at least two protrusions (6*a*) with springy catches 6(*b*), situated along opposite sides of the top cover (6), fastened in the frontal plate's (5) notches (5*b*) and connecting the top cover (6) with the frontal plate (5); light source lenses (14), fixed with LED plates (13) in radiator's (4) two rectangular seats by use of the seats on the top covers (6) bottom side, pressing LED plates (13) against the two rectangular seats' bottoms; optical element (15) of PIR sensor, fitted in the central large-diameter port, between PIR sensor electronic board (12) and the top cover (6), and adjustment knobs (9), fixed in top cover's (6) seats, between PIR sensor electronic board (12) and the top cover (6).

2. The LED lighting lamp according to the claim 1, characterized in that the cover (1) has a collar (1*c*) in the form of cylinder, in which a feeding socket (16) as well as a seat (1*d*) to fix the connecting cube (17) are fastened.

3. The LED lighting lamp according to the claim 1, characterized in that the feeding socket (16) is fixed to the cover's (1) bottom with screws (19) and nuts (20).

4. The LED lighting lamp according to the claim 1, characterized in that the housing (2) has on its lower surface a collar (2*e*) in the form of cylinder, concentric with the seat (2*f*) for an additional feeding socket's (16) insulation.

5. The LED lighting lamp according to the claim 1, characterized in that the bars (4*a*) have ends with smaller diameters than their other sections, allowing them to enter into the holes in the electronic board of the feeder (11).

6. The LED lighting lamp according to the claim 1, characterized in that the bars (4*b*) have ends with smaller diameters than their other sections, allowing them to enter into the holes in PIR sensor electronic board (12).

7. The LED lighting lamp according to the claim 1, characterized in that on the upper surface of the PIR sensor electronic board (12) a base (8) and electronic elements of PIR sensor are fixed, while electrical outputs in the form of pins (12*a*), passing through second insulators (7) collar (7*a*) and introduced to the connector in the electronic board of the feeder (11) are placed on the lower surface of the PIR sensor electronic board (12).

8. The LED lighting lamp according to the claim 1, characterized in that the electronic LED plate (13) has electronic elements and at least one LED (21) fixed on its upper surface, while electrical outputs in the form of pins (13*a*), passing through the ports in radiator's (4) two rectangular seats respectively, and introduced into the connector on the electronic board of the feeder (11).

9. The LED lighting lamp according to the claim 1, characterized in that an elongated lens of trapezoidal cross-section, having an internal longitudinal channel with a convex, half-round bottom makes the light source lens (14).

10. The LED lighting lamp according to the claim 1, characterized in that the light source lens (14) is constituted by an elliptical lens compound.

11. The LED lighting lamp according to the claim 1, characterized in that a dome is the optical element (15) of PIR sensor.

12. The LED lighting lamp according to the claim 1, characterized in that a Fresnel lens is the optical element (15) of PIR sensor.

13. The LED lighting lamp according to the claim 1, characterized in that springy catches (6*b*) are an integral part of top cover's (6) protrusions (6*a*).

14. The LED lighting lamp according to the claim 1 characterized in that it contains the cover (1) in the form of cuboid open at the top, with "U" letter shaped cross-section, having a port (1*a*) for power leads, ports for cover (1) fixing, an external collar (1*b*), catches (1*e*) feeding socket (16) and feeders connecting cube (17), fixed inside the cover (1) to its bottom; a housing (2) in the form of cuboid open at the top, with "U" letter shaped cross-section, having an external collar (2*a*) with rectangular recess, protrusions (2*b*) arranged on the vertical walls inside the housing (2), bars (2*c*), catches (2*d*), a seat (2*f*) in which pin ends (2*g*) are fastened to be connected with feeding socket (16), wherein the catches (2*d*) are connected with cover (1) catches (1*e*); an electronic board of the feeder (11), with ports for housing (2) bars (2*c*), electronic elements and electrical connectors placed on its upper surface as well as connector support (10) placed on its lower surface and connected with the pin ends (2*g*) of the housing's (2) seat (2*f*); first insulator form of a rectangular plate, fastened in the housing (2) collar's (2*a*) recess and having a central rectangular cavity with "U" letter shaped cross-section and rectangular and round ports in its bottom; a radiator (4) in the form of a rectangular mold, fastened in the cavity of first insulator (3) and having on its upper surface a central rectangular seat with "U" letter shape cross-section, inside which, at least two bars (4*b*) and one port are placed on its lower surface; two rectangular seats with "U" letter shaped cross-section, placed in parallel on both sides of the central rectangular seat, having a depth lower than the central rectangular seat and having equal widths with each other, each of them having in its bottom a port and at least two bars (4*a*) situated on the lower surface of the radiator (4), which pass through the holes in first insulator (3), pressing the electronic board of the feeder (11) against protrusions (2*b*) in housing (2), and—at least—two ports for screws (18), second insulator (7) fixed in the central rectangular seat of radiator (4) and having in its bottom at least two ports for bars (4*b*), one rectangular port with a collar (7*a*) situated on the external surface of second insulator (7) bottom, passing outside radiator (4) through the one port in the bottom of radiator's (4) central rectangular seat; PIR sensor electronic board (12), fastened in the second insulator (7), keeping a gap from its bottom and supported by the radiator's bars (4*b*): at least two plates (13) with LEDs (21), fastened in radiator's (4) two rectangular seats in such a way that the lower surface of the plate (13) keeps direct contact with the bottom surface of radiator's (4) two rectangular seats seat; a rectangular frontal plate (5), connected by screws (18) to the bars (2*c*) and fixing the radiator (4) in first insulator (3) cavity, having a central rectangular hole (5*a*), notches (5*b*) in the corners, ports for screws (18) and an insulating first insulator (3) in housing (2) collar's (2*a*) recess, top cover (6) in the form of rectangular mold, having at least two longitudinal, ports with seats underneath, a central large-diameter port, two small-diameter ports situated on opposite sides of the central large-diameter port and having seats on the top cover's (6) bottom side, at least two protrusions (6*a*) with springy catches 6(*b*), situated along opposite sides of the top cover (6), fastened in the frontal plate's (5) notches (5*b*) and connecting the top cover (6) with the frontal plate (5); light source lenses (14), fixed with LED plates (13) in radiator's (4) two rectangular seats by use of the seats on the top covers (6) bottom side, pressing LED plates (13) against the two rectangular seats' bottoms; optical element (15) of PIR sensor, fitted in the central large-diameter port, between PIR sensor electronic board (12) and the top cover (6), and adjustment knobs (9), fixed in top cover's (6) seats, between PIR sensor electronic board (12) and the top cover (6), wherein a rectangular frontal plate (5), having a central rectangular port 5*a*, notches 5*b* in the corners, ports for screws 18, connected by screws 18 to bars (2*c*) and fixing the radiator (4) in the cavity of the first insulator (3), and the first insulator (3) in housing (2) collar's (2*a*) recess.

15. The LED lighting lamp according to the claim 8, characterized in that the plate (13) has electronic elements and at least one LED (21) fixed on its upper surface, while electrical outputs in the form of pins (13*a*), passing through the ports in radiator's (4) two rectangular seats respectively, and introduced into the connector on the electronic board of the feeder (11), wherein the plate (13) with LEDs (21) is a plate made of a standard laminate, wherein electronic elements and at least one LED (21) are fixed on its upper surface, and the plate has electrical terminals, for example—in the form of pins (13*a*), wherein the pins (13*a*) pass through the ports in radiator's (4) two rectangular seats and are introduced, into the respective joints on feeder's electronic board (11), wherein the lower surface of plate (13) keeps direct contact with the surface of radiator's (4) seat, in order to improve the transfer of heat from LEDs (21) to radiator (4).

* * * * *